US008456094B2

(12) United States Patent
Huang et al.

(10) Patent No.: US 8,456,094 B2
(45) Date of Patent: Jun. 4, 2013

(54) LIGHT EMITTING DEVICE OPEN/SHORT DETECTION CIRCUIT

(75) Inventors: Pei-Cheng Huang, Taipei (TW); Kuo-Chi Liu, Hsinchu (TW); Ming-Hsueh Lee, Kaohsiung (TW); Shih-Hua Chien, Zhubei (TW); Chao-Hua Wu, New Taipei (TW)

(73) Assignee: Richtek Technology Corporation, Hsin-Chu (TW)

( * ) Notice: Subject to any disclaimer, the term of this patent is extended or adjusted under 35 U.S.C. 154(b) by 209 days.

(21) Appl. No.: 13/136,383

(22) Filed: Jul. 29, 2011

(65) Prior Publication Data

US 2012/0293082 A1 Nov. 22, 2012

(30) Foreign Application Priority Data

May 18, 2011 (TW) ..... 100208903 U

(51) Int. Cl.
*H05B 37/00* (2006.01)

(52) U.S. Cl.
USPC ..... 315/192

(58) Field of Classification Search
None
See application file for complete search history.

(56) References Cited

U.S. PATENT DOCUMENTS

2003/0058093 A1* 3/2003 Dohi et al. ..... 340/506
2008/0094349 A1 4/2008 Liao et al.

* cited by examiner

*Primary Examiner* — Crystal L Hammond
(74) *Attorney, Agent, or Firm* — Tung & Associates

(57) ABSTRACT

The present invention discloses a light emitting device open/short detection circuit, which is used for detecting at least one light emitting device string open/short. Each light emitting device string has a first end and a second end, wherein the first end is coupled to a voltage supply circuit to supply electrical power to the light emitting devices. The open/short detection circuit includes: an abnormal voltage detection circuit coupled to the light emitting device strings for receiving voltages of the second ends respectively and generating an abnormal voltage detection signal; a voltage setting circuit coupled to the abnormal voltage detection circuit for setting an abnormal reference level; and a determination circuit coupled to the voltage setting circuit. When the abnormal voltage detection signal is equal to or over the abnormal reference level, the determination circuit generates an open/short detection signal for an abnormal condition detected.

15 Claims, 6 Drawing Sheets

LIGHT EMITTING DEVICE OPEN/SHORT DETECTION CIRCUIT

CROSS REFERENCE

The present invention claims priority to TW 100208903, filed on May 18, 2011.

BACKGROUND OF THE INVENTION

1. Field of Invention

The present invention relates to a light emitting device open/short detection circuit; particularly, it relates to a light emitting device open/short detection circuit with an adjustable reference voltage to determine open/short condition.

2. Description of Related Art

FIG. 1 shows a schematic diagram of a backlight control circuit of US Publication No. 2008/0094349. Referring to FIG. 1, besides a voltage supply circuit 11, an error amplifier circuit 13, a lowest voltage selection circuit 21, and current sources CS1-CSN, the backlight control circuit 30 also includes under current detection circuits UCD1-UCDN. These under current detection circuits UCD1-UCDN detect the current conditions on the light emitting diode (LED) paths 101-10N respectively to determine whether an under current status, i.e., a "no current" or "very low current" condition, occurs. When "no current" or "very low current" condition does not occur, the voltage signals on the LED paths 101-10N pass through the UCD circuits 31-3N to the corresponding voltage comparison paths 111-11N, so that a lowest voltage selection circuit 21 receives those signals, and selects a lowest voltage among them to input to the error amplifier 13. The error amplifier circuit 13 compares the lowest voltage with a reference voltage Vref to generate a control signal 15.

When anyone or more LED paths 101-10N have no current or very low current, the UCD circuits 31-3N exclude the corresponding one or more voltage comparison paths 111-11N so that they are not valid inputs to the lowest voltage selection circuit 21, that is, the lowest voltage selection circuit 21 does not accept signals on these invalid voltage comparison paths 111-11N to avoid an error.

In the aforementioned prior art, the under current detection circuits UCD1-UCDN are generally integrated with the backlight control circuit 30 in an integrated circuit (IC) chip, and therefore the circuit can not flexibly set different criteria such as the number of the short-circuited LEDs in the LED path for the under current detection circuits UCD1-UCDN to determine a failure, and thus the circuit may be over-protected. Besides, for various applications, it is also required to detect an open-circuit condition in the LED path.

In view of the foregoing, the present invention provides a light emitting device open/short detection circuit, which may be located outside a light emitting device control circuit (which is often integrated as an IC) for flexible adjustment to optimize the detection parameters/criteria such as the number of the short-circuited light emitting devices, to broaden the applications of the light emitting device control circuit, and to simplify the circuit design of the light emitting device control circuit.

SUMMARY OF THE INVENTION

The objective of the present invention is to provide a light emitting device open/short detection circuit.

To achieve the objectives mentioned above, the present invention provides a light emitting device open/short detection circuit, which is used for detecting whether at least one light emitting device string is open-circuited or short-circuited, wherein each light emitting device string includes one or more light emitting devices connected in series, and each light emitting device string has a first end and a second end, the first end being coupled to a power supply circuit to supply electrical power to the light emitting devices, the light emitting device open/short detection circuit comprising: a first abnormal voltage detection circuit coupled to the second ends of the light emitting device strings, for receiving voltages at the second ends of the light emitting device strings and generating a first abnormal voltage detection signal; a first voltage setting circuit coupled to the first abnormal voltage detection circuit, for setting a first abnormal reference level; and a first determination circuit coupled to the first voltage setting circuit, when the first abnormal voltage detection signal reaches or exceeds the first abnormal reference level, the first determination circuit generates a first open/short detection signal to indicate an abnormal condition.

In another embodiment, the present invention provides a light emitting device open/short detection circuit, which is used for detecting whether at least one light emitting device string is open-circuited or short-circuited, wherein each light emitting device string includes one or more light emitting devices connected in series, and each light emitting device string has a first end and a second end, the first end being coupled to a power supply circuit to supply electrical power to the light emitting devices, the light emitting device open/short detection circuit comprising: a second abnormal voltage detection circuit coupled to the light emitting device strings, for receiving voltages at the second ends of the light emitting device strings and generating a second abnormal voltage detection signal; and a second determination circuit coupled to the second abnormal voltage detection circuit, for generating an open/short detection signal when the second abnormal voltage detection signal is abnormally low.

The aforementioned two embodiments may be combined to become another embodiment.

In a preferred embodiment, the first voltage setting circuit may include a Zener diode, wherein a reverse breakdown voltage of the Zener diode determines the aforementioned abnormal reference level.

The objectives, technical details, features, and effects of the present invention will be better understood with regard to the detailed description of the embodiments below.

DESCRIPTION OF THE PREFERRED EMBODIMENTS

Figure 1:
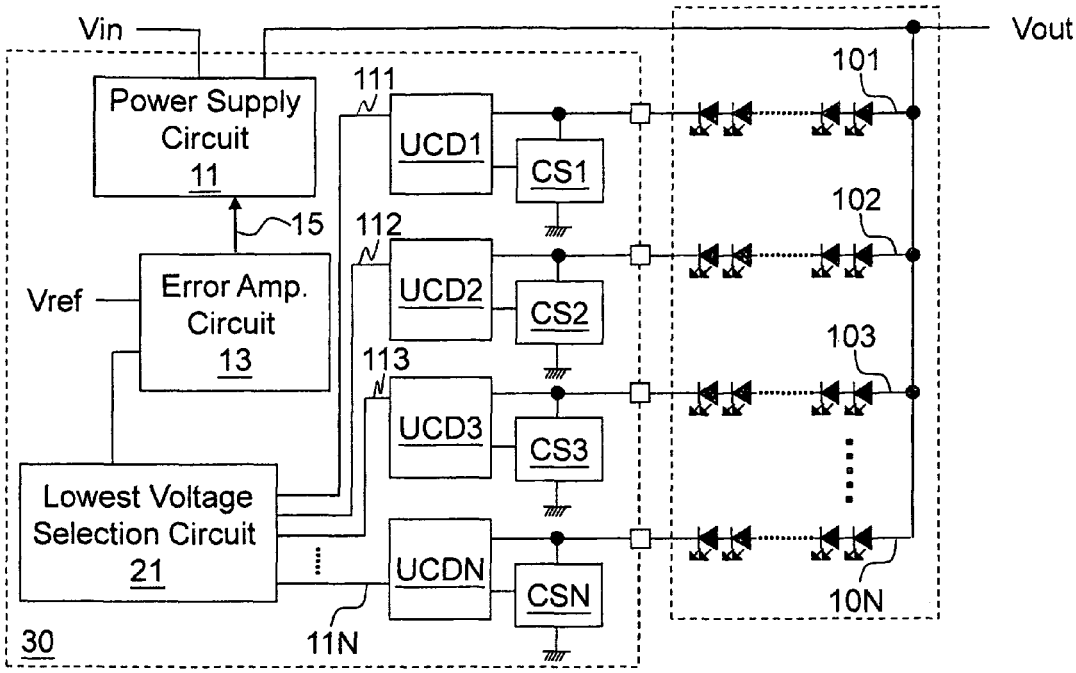
Fig. 1 (Prior Art)
FIG. 1 shows a schematic diagram of a backlight control circuit of US Publication No. 2008/0094349.
Figure 2A:
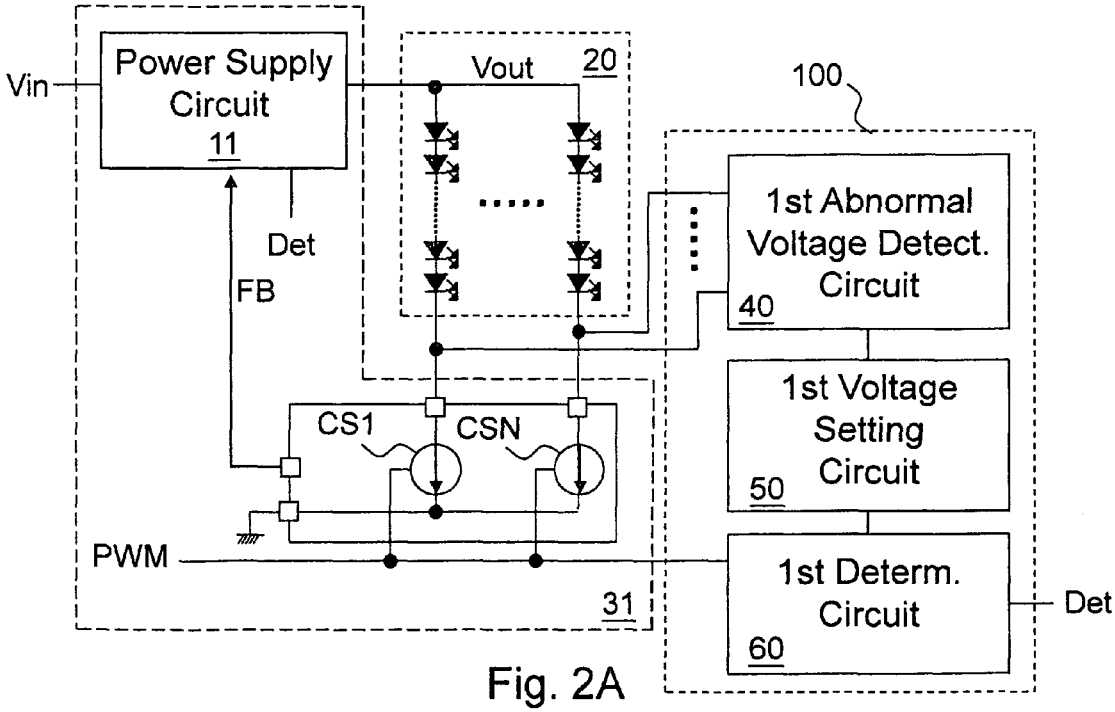
FIG. 2A shows a first embodiment of the present invention.

Please refer to FIG. 2A, which shows a first embodiment of the present invention. As shown in the figure, a light emitting device open/short detection circuit 100 for example is used for detecting whether one or more light emitting devices of anyone or more light emitting device strings in a light emitting device circuit 20 are short-circuited. Each light emitting device string includes one or more light emitting devices connected in series, and each light emitting device string has a first end and a second end. The first end is coupled to a power supply circuit 11 in a control circuit 31, which supplies electrical power to the light emitting devices. The power supply circuit 11 converts an input voltage Vin to an output voltage Vout according to a feedback signal FB. In some applications, the control circuit 31 may be entirely integrated in an IC chip. In other applications, the control circuit 31 may be integrated in an IC chip excluding all or part of the power supply circuit 11 and/or current sources CS1-CSN.

In this embodiment, the light emitting device open/short detection circuit 100 includes: a first abnormal voltage detection circuit 40, a first voltage setting circuit 50, and a first determination circuit 60. The first abnormal voltage detection circuit 40 is coupled to the second ends of the light emitting device strings, for receiving voltages at the second ends of the light emitting device strings and generating a first abnormal voltage detection signal. The first voltage setting circuit 50 is coupled to the first abnormal voltage detection circuit 40, for setting an abnormal reference level. The first determination circuit 60 is coupled to the first voltage setting circuit 50. When the first abnormal voltage detection signal reaches or exceeds the abnormal reference level, the first determination circuit 60 generates an open/short detection signal Det to indicate an abnormal condition. In some applications, the light emitting devices are controlled by a dimming signal, which is for example but not limited to a pulse width modulation (PWM) signal PWM as shown in the figure. In this case, preferably, the first determination circuit 60 is also coupled to this PWM signal PWM for performing the determination at proper timings to generate the open/short detection signal Det.

Figure 2B:
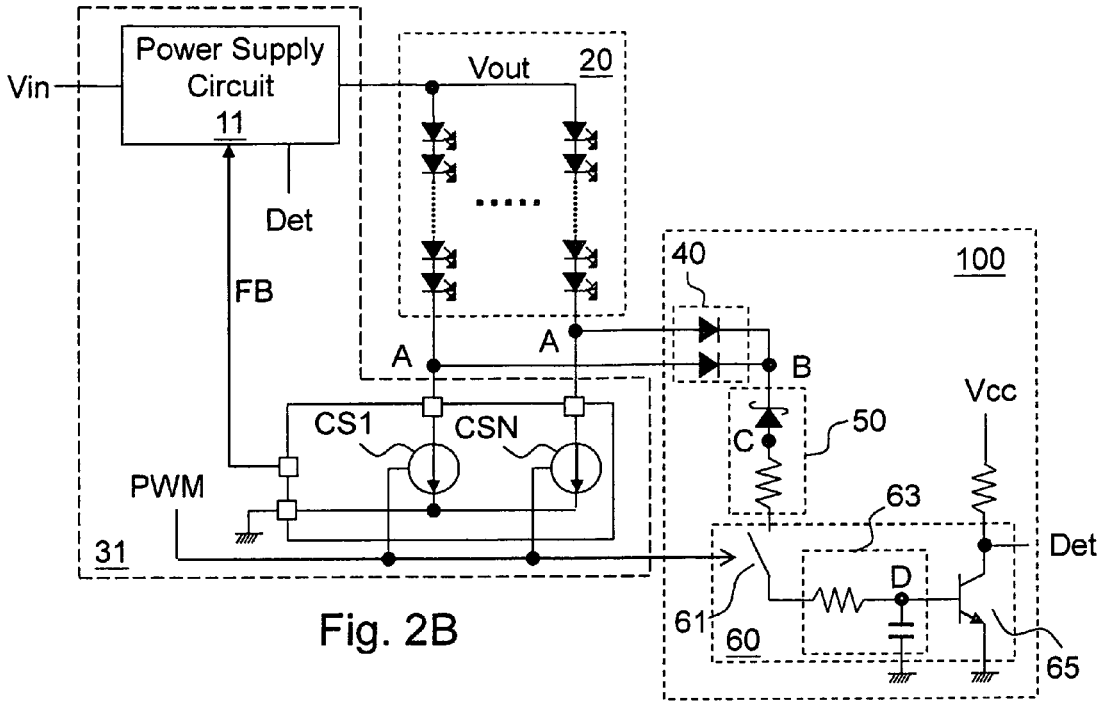
FIG. 2B shows a more specific embodiment of a light emitting device open/short detection circuit 100 of the present invention.

FIG. 2B shows a more specific embodiment of the light emitting device open/short detection circuit 100 of the present invention. The first abnormal voltage detection circuit 40 includes for example but not limited to multiple diodes as shown in the figure, and each diode has a anode coupled to the second end of the corresponding light emitting device string (node A as shown in the figure) for receiving a voltage at the second end, and generating the first abnormal voltage detection signal at node B. When one or more light emitting devices in a light emitting device string are short-circuited, the node A corresponding to this light emitting device string will be at an abnormally high level. The first voltage setting circuit 50 includes for example but not limited to a Zener diode as shown in the figure, and the Zener diode has a cathode coupled to the first abnormal voltage detection circuit 40 for receiving the first abnormal voltage detection signal at node B. When a voltage drop between node B and node C exceeds a reverse breakdown voltage of the Zener diode, the Zener diode is reversely turned ON. On the contrary, when a voltage drop between node B and node C does not exceed the reverse breakdown voltage of the Zener diode, the Zener diode is OFF. Thus, the first determination circuit 60 may determine whether the first abnormal voltage detection signal reaches or exceeds the abnormal reference level. That is, the reverse breakdown voltage of the Zener diode is equivalent to the abnormal reference level, and when the voltage drop between node B and node C reaches or exceeds the reverse breakdown voltage of the Zener diode, it indicates that the first abnormal voltage detection signal reaches or exceeds the abnormal reference level. Accordingly, a user may select a Zener diode with specific characteristics, or connect a specific number of the Zener diodes, to set the abnormal reference level.

When the light emitting devices are controlled by the dimming signal PWM, the first determination circuit 60 is preferably coupled to this signal, for the reason below. When the dimming signal PWM is at low level, current through each light emitting string is very low, so the voltage drop across the light emitting devices is also very low. Hence, the voltage level at node A is close to the output voltage Vout, and in this condition, it is difficult for the first abnormal voltage detection circuit 40 to identify whether the low voltage drop is caused by one or more short-circuited light emitting devices or it is in normal operation. When the dimming signal PWM is at high level, current through each light emitting device string is at a normal level, and in this condition, the first abnormal voltage detection circuit 40 is able to identify whether the high voltage which exceeds the abnormal reference level is caused by one or more short-circuited light emitting devices.

In this embodiment, the first determination circuit 60 for example includes a first switch circuit 61, a low-pass filter circuit 63, and a transistor 65. The first switch circuit 61 turns ON and OFF according to the dimming signal PWM. The low-pass filter circuit 63 is for example but not limited to an RC circuit as shown in the figure. The transistor 65 is for example but not limited to a bipolar junction transistor (BJT) as shown in the figure. If the light emitting devices are not controlled by the dimming signal PWM, the first switch circuit 61 and/or the low-pass filter circuit 63 may be omitted. If the light emitting devices are controlled by the dimming signal PWM, but a high frequency noise is acceptable in circuit operation, the low-pass filter circuit may be omitted. The basic function of the first determination circuit 60 is thus: when the control end of the transistor 65 (the base of the BJT) is at relatively high level, the first determination circuit 60 generates an open/short detection signal Det with low level, to indicate the abnormal condition. The function of the first switch circuit 61 is to operate the transistor 65 at proper timings, and the function of the low-pass filter circuit 63 is to filter out high frequency noises.

Figure 3:
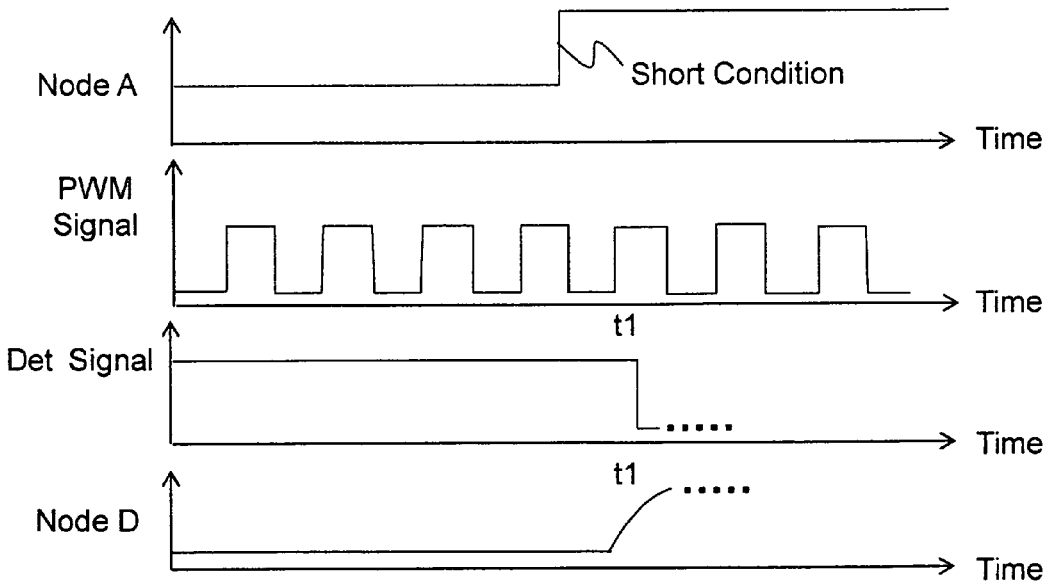
FIG. 3 shows signal waveforms at certain nodes of the embodiment shown in FIG. 2B.

More specifically, please refer to FIG. 2B in conjunction with FIG. 3. The light emitting device open/short detection circuit 100 of this embodiment operates as below. When a short-circuit condition happens in one or more light emitting device strings, the voltage level at corresponding node A increases to high level as shown by the signal waveform of node A in FIG. 3. At time point t1, when the dimming signal PWM switches to high level as shown in the figure, the first switch circuit 61 turns ON. If the voltage drop between node B and node C exceeds the reverse breakdown voltage of the Zener diode, the Zener diode will reversely turn ON, which means that the first abnormal voltage detection signal reaches or exceeds the first abnormal reference level, and at this time point, node C is at relatively high level. Accordingly, the low-pass filter circuit 63 generates a signal waveform at nod D as shown in the figure. When the voltage at node D is high enough for turning ON the transistor 65, the open/short detection signal Det will be as shown in the figure, switching from high level to low level, indicating a short-circuit condition of the light emitting device(s) in the light emitting device string(s).

Comparing with the prior art, this embodiment is advantageous in that, as the a light emitting device open/short detection circuit 100 is located outside the IC chip, the user may select a Zener diode with a proper reverse breakdown voltage, or a proper number of Zener diodes connected in series, to set different abnormal reference levels to fulfill different requirements; in this way, the threshold to determine the short-circuit condition is adjustable. More specifically, if a user uses a Zener diode with a higher reverse breakdown voltage or more number of Zener diodes connected in series, it means that a higher threshold for determine the short-circuit condition is set, requiring more light emitting devices to be short-circuited in a light emitting device string. On the other hand, if a user uses a Zener diode with a lower reverse breakdown voltage or a less number of Zener diodes connected in series, it means that a lower threshold for determine the short-circuit condition is set, requiring less light emitting devices to be short-circuited in a light emitting device string. As such, the short-circuit detection is more flexible.

Figure 4A:
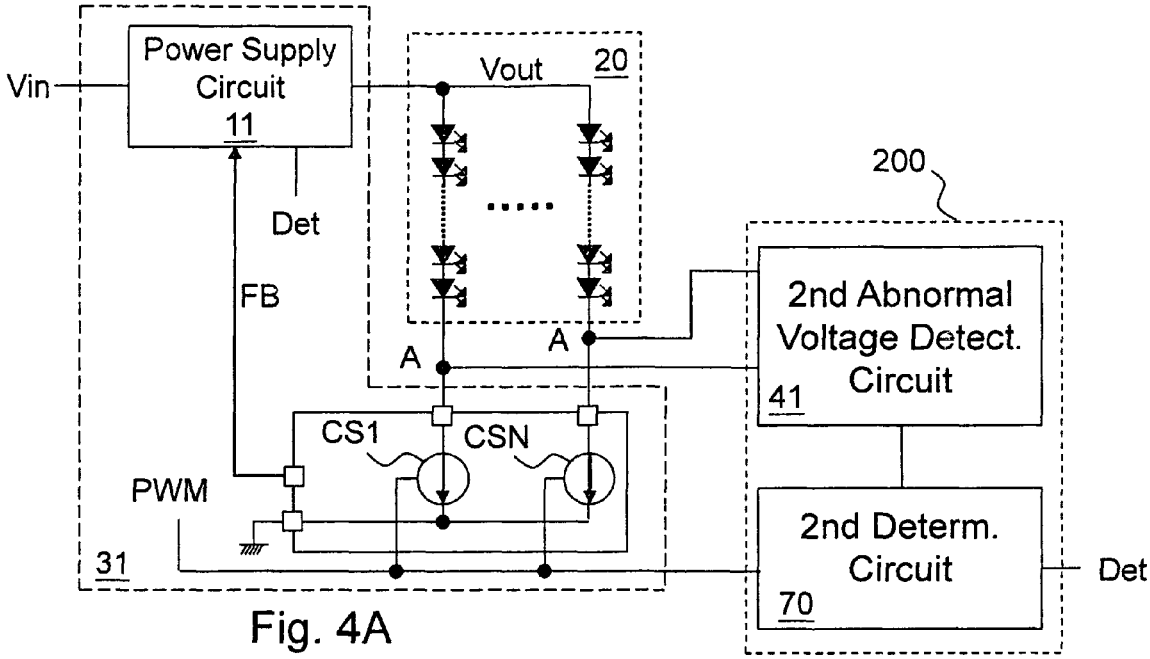
FIG. 4A shows another embodiment of the present invention.

FIG. 4A shows another embodiment of the present invention. As shown in the figure, a light emitting device open/short detection circuit 200 for example is used for detecting whether one or more light emitting devices of anyone or more light emitting device strings in the light emitting device circuit 20 are short-circuited. When an open-circuit condition happens in one or more light emitting devices of anyone or more light emitting device strings, the corresponding node A will abnormally decrease to a zero level or close to the zero level. In this embodiment, the light emitting devices are controlled by the dimming signal PWM as shown in the figure. The light emitting device open/short detection circuit 200 includes: a second abnormal voltage detection circuit 41 and a second determination circuit 70. The second abnormal voltage detection circuit 41 is coupled to the second ends of the light emitting device strings, for receiving voltages at the second ends of the light emitting device strings and generating a second abnormal voltage detection signal. The second determination circuit 70 is coupled to the second abnormal voltage detection circuit 41, and when the light emitting devices are controlled by the dimming signal PWM, the second determination circuit 70 is preferably also coupled to the dimming signal PWM. The second determination circuit 70 generates the open/short detection signal according to the dimming signal PWM and the second abnormal voltage detection signal. Similar to the previous embodiment, the purpose of the second determination circuit 70 to receive the dimming signal PWM is to perform the determination at proper timings. When the dimming signal PWM is at high level, current through each light emitting string is at a normal level, so the voltage drop across the light emitting device string is very high. Thus, the voltage level at node A is very low, and in this condition, it is difficult for the second abnormal voltage detection circuit 41 to identify whether the low voltage at node A is caused by an open-circuit condition of a light emitting device or the light emitting device string is in normal operation. When the dimming signal PWM is at low level, the second abnormal voltage detection circuit 41 is then able to identify whether the low voltage at nod A is caused by an open-circuit condition of a light emitting device.

Figure 4B:
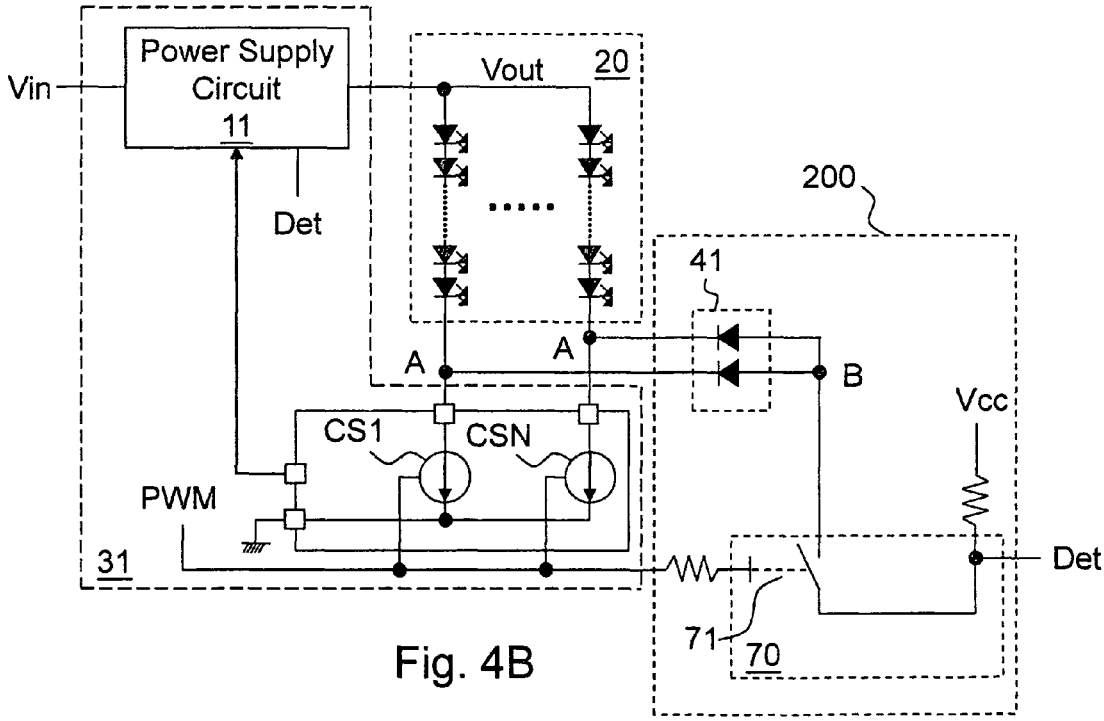
FIG. 4B shows a more specific embodiment of the light emitting device open/short detection circuit 200 of the present invention.

FIG. 4B shows a more specific embodiment of the light emitting device open/short detection circuit 200 of the present invention. The second abnormal voltage detection circuit 41 includes for example but not limited to multiple diodes as shown in the figure. The cathode of each diode is coupled to the second end of a corresponding light emitting device string (node A as shown in the figure) for receiving a voltage at the second end, and generating the second abnormal voltage detection signal at node B. The second determination circuit 70 is coupled to the second abnormal voltage detection circuit 41. The second determination circuit 70 receives the dimming PWM and the voltage of node B, and determines whether or not to generate the open/short detection signal Det accordingly.

Figure 5:
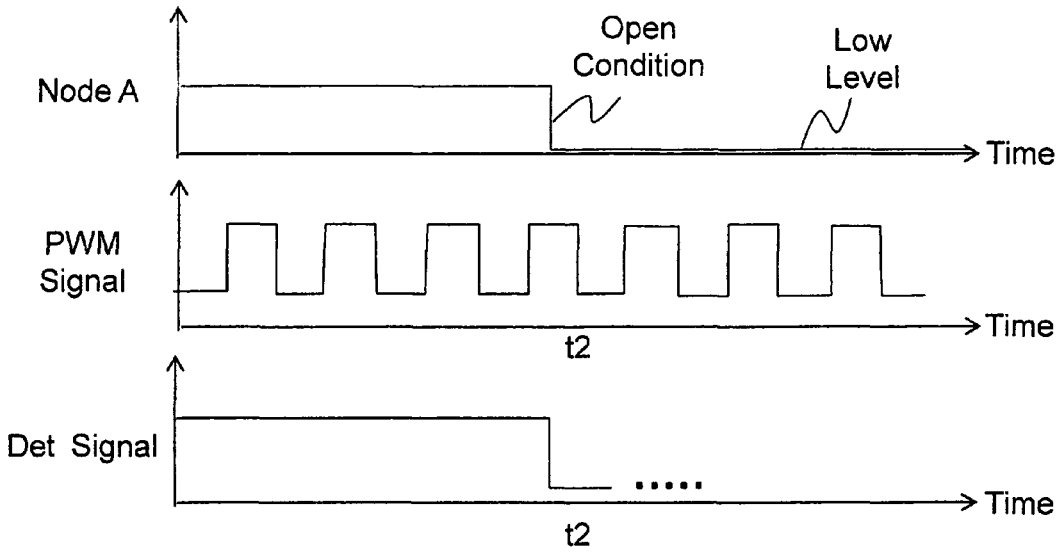
FIG. 5 shows signal waveforms at certain nodes of the embodiment shown in FIG. 4B.

Please refer to FIG. 4B in conjunction with FIG. 5. The light emitting device open/short detection circuit 200 of this embodiment operates as below. When an open-circuit condition happens in one or more light emitting device strings, i.e., node A is disconnected from the output voltage Vout, the voltage level at node A decreases to very low level as shown by the signal waveform of node A in FIG. 5. At time point t2, when the dimming signal PWM is at low level as shown in the figure, the second switch circuit 71 turns ON (the second switch circuit 71 for example may be a PMOS transistor, or an NMOS transistor but receiving an inverted signal of the dimming signal PWM), and if the voltage at node A is lower than the voltage at node B, current flows from a supply voltage Vcc to current sources CS1-CSN via the second switch circuit 71, node B, and node A; hence, the open/short detection signal Det will be as shown in the figure, switching from high level to low level, to indicate that an open-circuit condition happens in the light emitting device string(s).

Figure 6A:
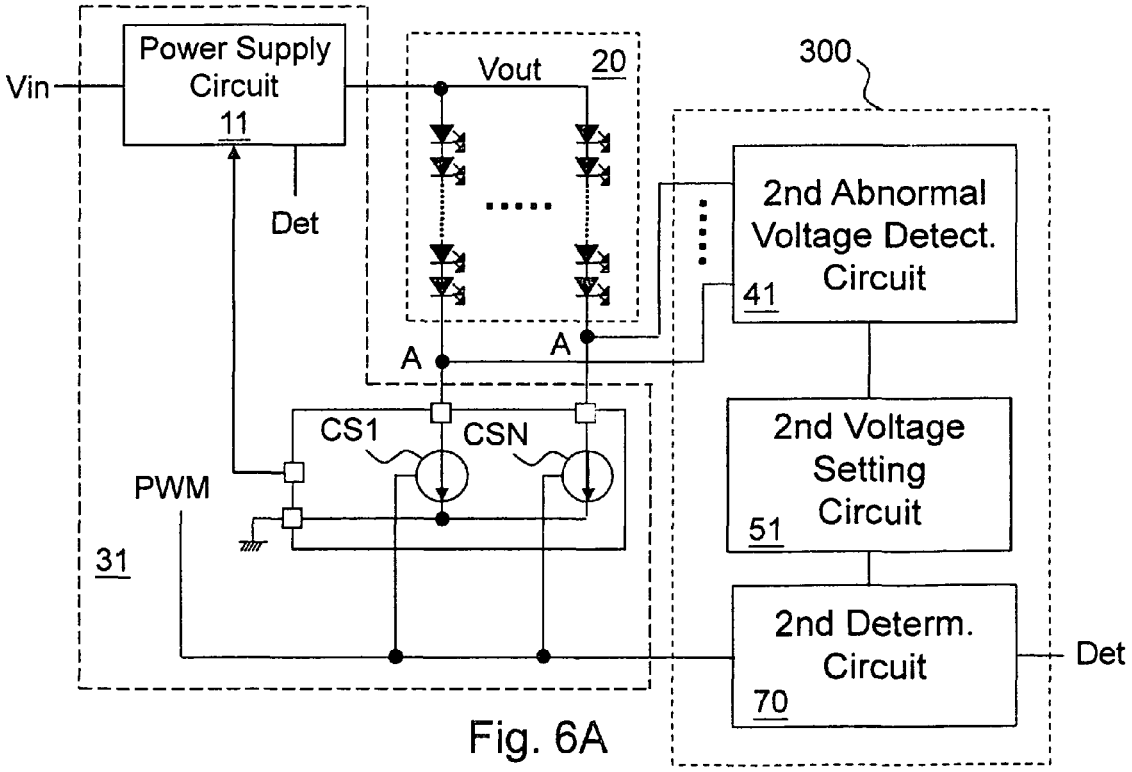
FIG. 6A shows another embodiment of the present invention.

FIG. 6A shows another embodiment of the present invention. As shown in the figure, a light emitting device open/short detection circuit 300 for example is used for detecting whether one or more light emitting device strings in the light emitting device circuit 20 are open-circuited, or whether node A is at very low level. This embodiment is different from the embodiment shown in FIG. 4A in that, in this embodiment, the light emitting device open/short detection circuit 300 further includes a second voltage setting circuit 51 besides the second abnormal voltage detection circuit 41 and the second determination circuit 70. The second voltage setting circuit 51 is coupled to the second abnormal voltage detection circuit 41, and the second voltage setting circuit 51 is for setting the abnormal reference level.

Figure 6B:
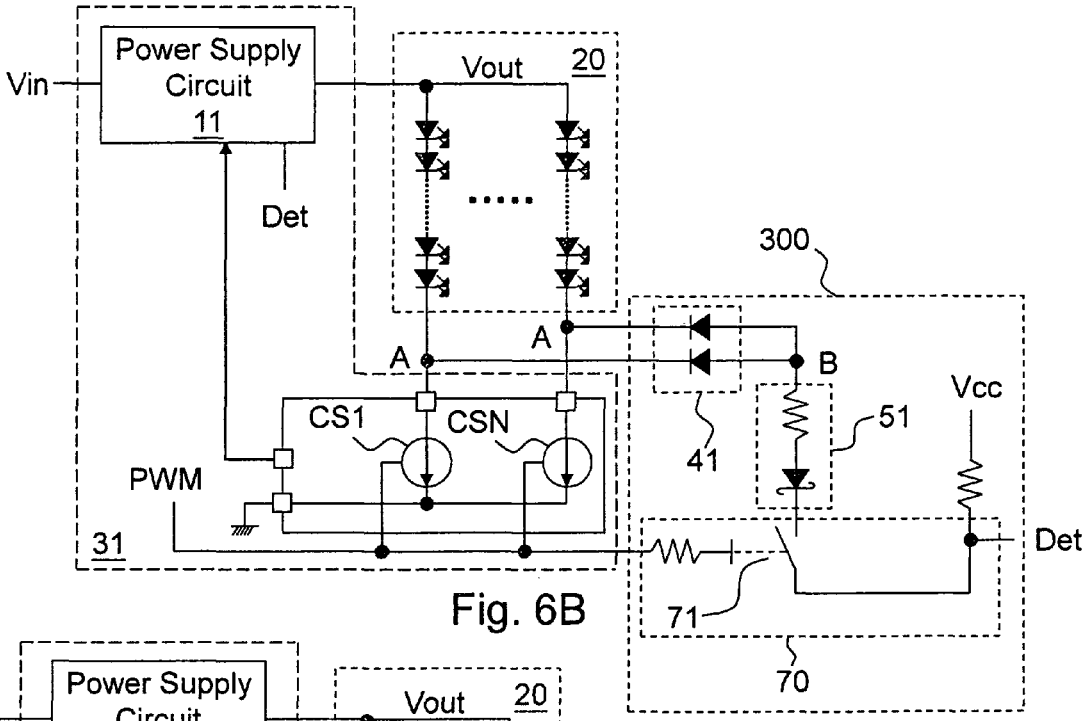
FIG. 6B shows a more specific embodiment of the light emitting device open/short detection circuit 300 of the present invention.

FIG. 6B shows a more specific embodiment of the light emitting device open/short detection circuit 300 of the present invention. The second voltage setting circuit 51 includes for example but not limited to a Zener diode as shown in the figure, and the Zener diode has an anode coupled to the second abnormal voltage detection circuit 41 for receiving the second abnormal voltage detection signal at node B. When the open-circuit condition happens, node A is at very low level, and when the dimming signal PWM is at low level, a second switch circuit 71 is ON. When a reverse bias in the Zener diode exceeds the reverse breakdown voltage of the Zener diode, the Zener diode is reversely turned ON, such that the open/short detection signal Det switches from high level to low level as shown in the figure, indicating that an open-circuit condition happens in the light emitting device string(s).

Figure 7A:
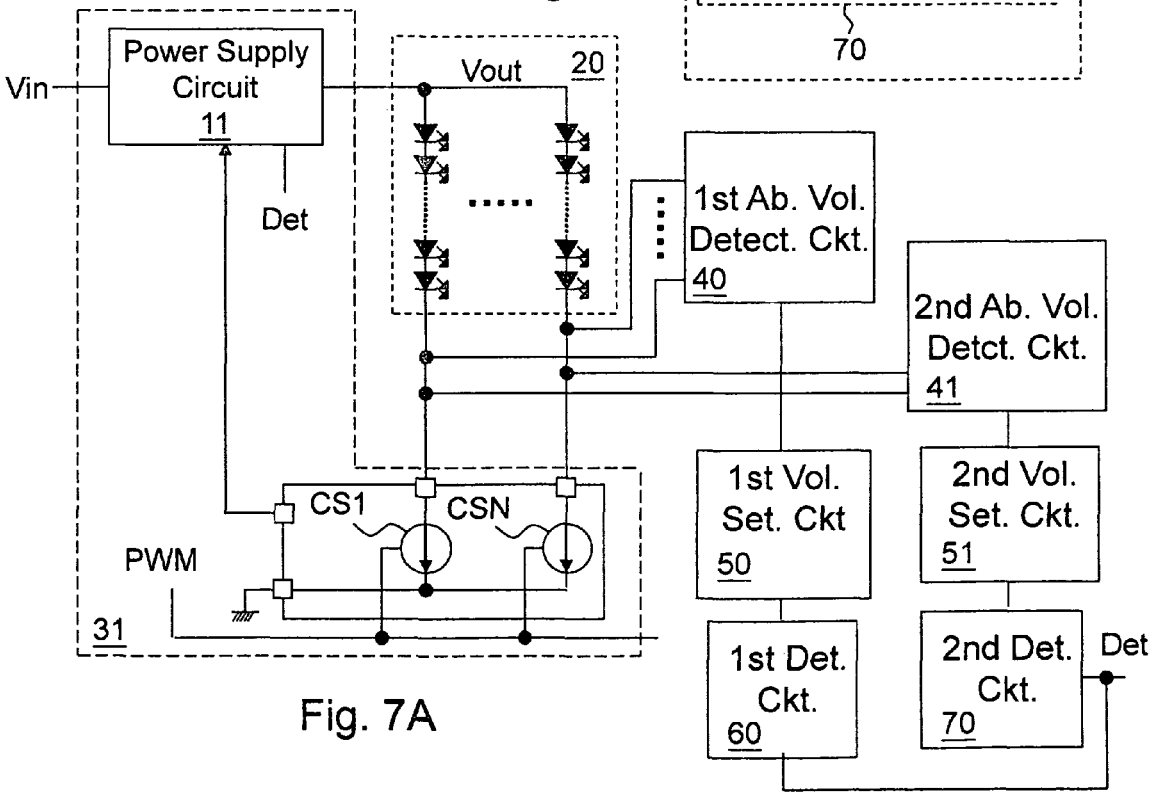
FIG. 7A shows another embodiment of the present invention.

FIG. 7A shows another embodiment of the present invention. This embodiment combines the embodiments shown in FIGS. 2A and 6A, such that this embodiment can detect both or either one of open-circuit and short-circuit conditions of one or more light emitting device strings in the light emitting device circuit 20.

Figure 7B:
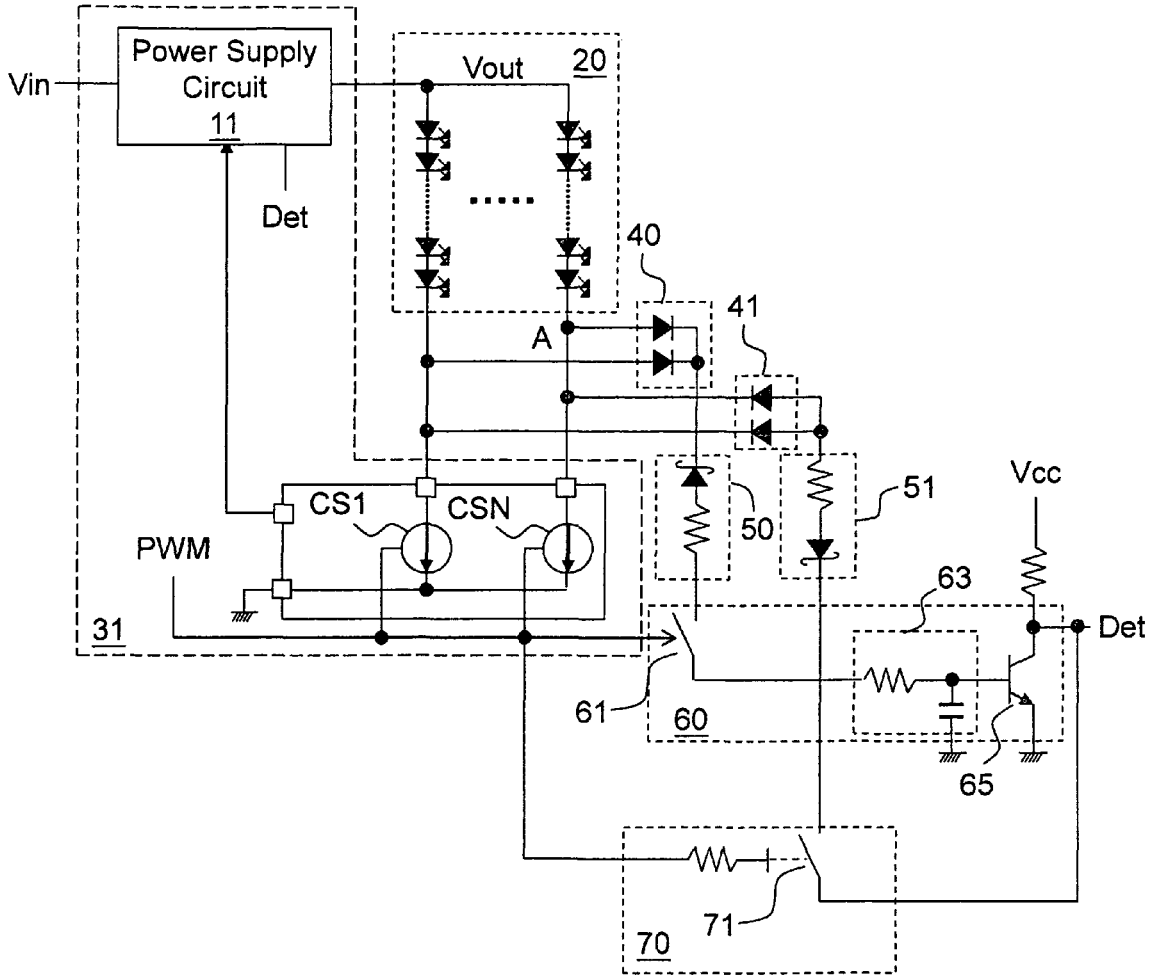
FIG. 7B shows a more specific embodiment of the light emitting device open/short detection circuit shown in FIG. 7A of the present invention.

FIG. 7B shows a more specific embodiment of the embodiment shown in FIG. 7A. This embodiment combines the embodiments shown in FIGS. 2B and 6B, such that this embodiment can detect both or either one of open-circuit and short-circuit conditions of one or more light emitting device strings in the light emitting device circuit 20.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, a device which does not substantially influence the primary function of a signal can be inserted between any two devices in the shown embodiments, such as other switches. For another example, in certain arrangement, the output voltage Vout is negative, and the light emitting devices are reversely coupled to the output voltage Vout; in this case, corresponding amendment of the circuit is needed, such as connecting the Zener diode in a reverse direction in the voltage setting circuit, etc. In view of the foregoing, the spirit of the present invention should cover all such and other modifications and variations, which should be interpreted to fall within the scope of the following claims and their equivalents.

What is claimed is:

1. Alight emitting device open/short detection circuit, for detecting whether at least one light emitting device string is open-circuited or short-circuited, wherein each light emitting device string includes one or more light emitting devices connected in series, and each light emitting device string has a first end and a second end, the first end being coupled to a power supply circuit to supply electrical power to the light emitting devices, the light emitting device open/short detection circuit comprising:

a first abnormal voltage detection circuit coupled to the second ends of the light emitting device strings, for receiving voltages at the second ends of the light emitting device strings and generating a first abnormal voltage detection signal;

a first voltage setting circuit coupled to the first abnormal voltage detection circuit, for setting a first abnormal reference level; and a first determination circuit coupled to the first voltage setting circuit, when the first abnormal voltage detection signal reaches or exceeds the first abnormal reference level, the first determination circuit generates a first open/short detection signal to indicate an abnormal condition.

2. The light emitting device open/short detection circuit of claim 1, wherein the light emitting devices are controlled by a pulse width modulation (PWM) signal, and the first determination circuit is coupled to the PWM signal.

3. The light emitting device open/short detection circuit of claim 1, wherein the first abnormal voltage detection circuit includes one or more diodes, each of which has an anode coupled to the second end of a corresponding one of the light emitting device strings.

4. The light emitting device open/short detection circuit of claim 1, wherein the first voltage setting circuit includes at least one Zener diode coupled to the abnormal voltage detection circuit, wherein a reverse breakdown voltage of the Zener diode determines the first abnormal reference level.

5. The light emitting device open/short detection circuit of claim 1, wherein the first determination circuit includes: a transistor which is coupled to a voltage at a node, and outputs the open/short detection signal from the node, the transistor being turn ON to change the level of the open/short detection signal when the first abnormal voltage detection signal reaches or exceeds the first abnormal reference level.

6. The open/short detection circuit of claim 5, wherein the first determination circuit further includes:

a first switch circuit, which is coupled to the first voltage setting circuit, and is controlled by a dimming signal;

a low pass filter, which is coupled to the first switch circuit to receive signals outputted from the first switch circuit for delivering the signals to a control end of the transistor.

7. The open/short detection circuit of claim 1 further comprising:

a second abnormal voltage detection circuit, which is coupled to the second ends of the light emitting device strings respectively, for receiving voltages of the second ends of the light emitting device strings respectively and generating a second abnormal voltage detection signal; and a second determination circuit, which is coupled to the second abnormal detection circuit, when the second abnormal voltage detection signal is abnormally low, the second determination circuit generates an open/short detection signal.

8. The open/short detection circuit of claim 7, wherein the second abnormal voltage detection circuit includes at least a diode which has a reverse end coupled to the second end of the light emitting device string.

9. The open/short detection circuit of claim 7, wherein the second determination circuit includes a second switch circuit, which is coupled to an coupled end between an internal voltage and the second abnormal voltage detection circuit, and outputs the open/short detection signal at the coupled node, and is controlled by a dimming signal, when the dimming signal is at low level, and the second abnormal voltage detection signal is abnormally low, the level of the open/short detection signal is changed.

10. The open/short detection circuit of claim 1 further comprising: a second voltage setting circuit, which is coupled between the second abnormal voltage detection circuit and the second determination circuit, for setting an abnormal reference level to determine whether the second abnormal voltage detection signal is abnormally low.

11. A light emitting device open/short detection circuit, which is used for detecting at least one light emitting device string open/short, wherein each light emitting device string includes one or multiple light emitting devices connected in series, and each light emitting device string has a first end and a second end, wherein the first end is coupled to a voltage supply circuit to supply electrical power to the light emitting devices, the light emitting device open/short detection circuit comprising:

an abnormal voltage detection circuit, which is coupled to the light emitting device strings respectively, for receiving voltages of the second ends of the light emitting device strings respectively and generating an abnormal voltage detection signal; and a determination circuit, which is coupled to the abnormal voltage detection circuit, when the abnormal voltage detection signal is abnormally low, the determination circuit generates an open/short detection signal.

12. The open/short detection circuit of claim 11, wherein the abnormal voltage detection circuit includes at least a diode which has a reverse end coupled to the second end of the light emitting device string.

13. The open/short detection circuit of claim 11, wherein the determination circuit includes a switch circuit, which is coupled to an coupled end between an internal voltage and the abnormal voltage detection circuit, and outputs the open/short detection signal at the coupled node, and is controlled by a dimming signal, when the dimming signal is at low level, and the abnormal voltage detection signal is abnormally low, the level of the open/short detection signal is changed.

14. The open/short detection circuit of claim 11 further comprising: a voltage setting circuit, which is coupled between the abnormal voltage detection circuit and the determination circuit, for setting an abnormal reference level to determine whether the abnormal voltage detection signal is abnormally low.

15. The open/short detection circuit of claim 14, wherein the voltage setting circuit includes at least one Zener diode coupled to the abnormal voltage detection circuit, wherein a reverse breakdown voltage of the Zener diode is used for setting the abnormal reference level.

* * * * *